United States Patent [19]

Kim et al.

[11] Patent Number: 4,882,264

[45] Date of Patent: Nov. 21, 1989

[54] COLOR DEVELOPER COMPOSITION

[75] Inventors: Hongzoon Kim, Boonton; Edward C. Saunders, Oakland; Harris Miller, Fort Lee, all of N.J.

[73] Assignee: Olin Hunt Specialty Products Inc., Cheshire, Conn.

[21] Appl. No.: 572,646

[22] Filed: Jan. 20, 1984

[51] Int. Cl.[4] ..... G03C 5/30; G03C 7/30

[52] U.S. Cl. ..... 430/467; 430/380; 430/436; 430/437; 430/468; 430/484

[58] Field of Search ..... 430/436, 437, 467, 468, 430/484, 380

[56] References Cited

U.S. PATENT DOCUMENTS

| | | | |
|---|---|---|---|
| Re. 30,064 | 8/1979 | Shimamura | 96/66.5 |
| 2,306,923 | 12/1942 | Wood | 95/88 |
| 2,875,049 | 2/1959 | Kridel | 96/66 |
| 3,039,869 | 6/1962 | Rogers | 96/3 |
| 3,462,269 | 8/1969 | Tassone | 96/55 |
| 3,746,544 | 7/1973 | Heilmann | 96/66.4 |
| 3,823,017 | 7/1974 | Hodes | 96/66.4 |
| 3,929,484 | 12/1975 | Ross | 96/55 |
| 3,994,730 | 11/1976 | Frank | 96/66.4 |
| 3,994,967 | 11/1976 | Ross | 260/519 |
| 4,036,643 | 7/1977 | Viro et al. | 430/214 |
| 4,052,214 | 10/1977 | Oishi et al. | 430/212 |
| 4,075,014 | 2/1978 | Gerhardt | 96/22 |
| 4,083,723 | 4/1978 | Shimamura | 96/66.5 |
| 4,095,982 | 6/1978 | Yoneyama | 96/50 |
| 4,124,391 | 11/1978 | Ogawa | 96/66.5 |
| 4,157,915 | 6/1979 | Hamaoka | 96/55 |
| 4,170,478 | 10/1979 | Case | 96/66.4 |
| 4,252,892 | 2/1981 | Case | 430/357 |
| 4,272,613 | 6/1981 | Shibaoka | 430/364 |
| 4,297,438 | 10/1981 | Häseler et al. | 430/436 |
| 4,298,681 | 11/1981 | Bulloch | 430/466 |
| 4,323,642 | 4/1982 | Levinson | 430/438 |

FOREIGN PATENT DOCUMENTS

| | | | |
|---|---|---|---|
| 112346 | 10/1976 | Japan | 430/468 |
| 30332 | 3/1978 | Japan | 430/467 |
| 72442 | 6/1981 | Japan | 430/468 |
| 811185 | 4/1959 | United Kingdom . | |
| 2065657 | 7/1981 | United Kingdom . | |

OTHER PUBLICATIONS

Bent et al., "Chemical Constitution, Electrochemical, Photographic and Allergenic Properties of P—Amino—N—Dialkyl—Anilines", J. Am. Chem. Soc., 73, 3100–3125, (1951).

Mason, "Black and White Developing Agents in Color Developing Solutions", Photographic Processing Chemistry, 252–255, (2nd Ed. 1975).

Lee, "Superadditivity", The Theory of the Photographic Process, 432–436, James, Ed. (4th Ed. 1977).

*Primary Examiner*—Richard L. Schilling

[57] ABSTRACT

A color developer composition that maintains developer activity in all color forming layers and increases developer capacity is disclosed. The color developer composition allows use of reduced temperature, process time, replenishment rate, or concentration of developing agent without causing color imbalance. The composition employs two or more different color developing agents in combination. Each agent in a composition is selected from the group consisting of p-amino-N-dialkylanilines and the salts thereof. The composition of the present invention may be employed in conventional color developing processes without any significant change in conventional processing procedures and steps.

1 Claim, No Drawings

COLOR DEVELOPER COMPOSITION

FIELD OF THE INVENTION

The present invention relates to color developer compositions. More particularly, the present invention relates to color developer compositions which maintain developer activity in all color forming layers and increase developer capacity, thus allowing the use of reduced temperature, process time, replenishment rate, or concentration of color developing agent without color imbalances.

BACKGROUND OF THE INVENTION

In the field of color photography, couplers, such as cyan, yellow, magenta or the like, are incorporated in a silver halide emulsion using various methods, and coated on a support to prepare a color photographic material, which is imagewise exposed and subjected to a series of photographic processing steps to form images.

The fundamental steps in photographic processing are a color-developing step and a silver-removal step. In the color-developing step, silver halide in an exposed silver halide color photographic material is reduced by color developing agents, thereby forming a silver image and, subsequently, the oxidized color developing agents react with the couplers to provide dye images. Then, the color photographic material is subjected to a second step to oxidize the silver formed in the preceding step with an oxidizing or bleaching agent. The thus oxidized silver is then dissolved with a complexing or fixing agent for silver ion to remove the silver from the photographic material. The photographic material then contains only dye images.

That process is applicable to the developing of photographic color negatives, photographic color positives, photographic color plates, and color cinematographic films. The developers currently and previously used in the trade to process such emulsions contain, as the color developing agent, an N,N-disubstituted p-phenylenediamine. In the course of color development, the color developing agent reacts with phenolic or active methylene couplers that are incorporated in sundry layers of the emulsion on a transparent base or paper and forms non-diffusing dyes that constitute the final image.

Such color developing agents, when in contact with exposed silver halide, distribute in three separate emulsion layers, undergo oxidation to quinone diimines which, in turn, react with the three different color couplers, each of which is present in a different emulsion layer. The amount of quinone diimine formed is directly proportional to the amount of silver halide that has been exposed and, therefore, determines the amount and the intensity of dye that is formed. This process is known as oxidative coupling. The combination of the layers of yellow, cyan, and magenta dyes in amounts determined by the exposed silver halide can be made to reproduce, with a high degree of faithfulness, the colors of the photographed subject.

From a practical point of view, the choice of developing agent is limited because of the characteristics demanded of the dyes, among which are included optimum spectral characteristics and resistance to fading. Also, because the most widely distributed color films and papers are made by and under the control of several manufacturers, the color developing agents must be specifically tailored to the existing color couplers present in such emulsions in order to form the correct dyes. Another required characteristic is non-allergenicity.

One particular N,N-disubstituted p-phenylenediamine color developing agent has gained wide acceptance in the trade and is the color developing agent recommended by the manufacturers for color developing their color papers. This is 4-amino-N-ethyl-N-beta methanesulfonamidoethyl-m-toluidene, hereinafter denominated "AEMT". This compound also is known as 4-amino-3-methyl-N-ethyl,N-beta methanesulfonamidoethyl aniline. AEMT has the following structural formula:

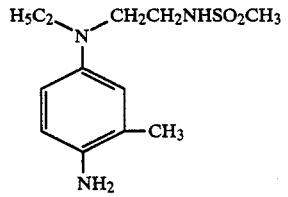

As a sesqui-sulfate monohydrate of the free base, the color developing agent is marketed by Eastman Kodak Company under the designation CD-3. As a phosphate monomethanolate of the free base, the color developing agent is manufactured and marketed by Philip A. Hunt Chemical Corporation as a proprietary product under the designation Chemical No. 300.

Another p-phenylenediamine color developing agent has gained wide acceptance in the trade and is the color developing agent recommended by the leading manufacturers for color developing their color negative films. This is 4-amino-3-methyl-N-ethyl-N-beta hydroxyethyl aniline, hereinafter denominated "AMEHEA". The sulfate salt is commonly used in practical color developer formulations.

Other N,N-disubstituted p-phenylenediamine color developing agents have been proposed, but none has found as wide an acceptance as AEMT and AMEHEA. Typical of other N,N-disubstituted p-phenylenediamine color developing agents that form non-diffusing dyes with phenolic and active methylene couplers are N,N-diethyl-p-phenylenediamine; 4-amino-3-methyl-N-diethyl aniline (known in the trade as "ADAT"); and similar N,N-disubstituted p-phenylenediamine color developing agents.

With these developing agents singly used in the respective processes noted, there are specific processing parameters established to produce standard photographic response characteristics accepted by the photographic industry. These parameters, including processing time, temperature, replenishment rate, and capacity, limit the speed and changes in them may increase the cost of processing photographic material. Improvements in one parameter cannot be made without tradeoffs in other parameters.

Current trends in photographic processing are towards shorter processing times, lower replenishment rates, higher developer activities, and more concentrated components. Numerous developer activity-increasing additives to allow reduced time, temperature, or replenishment rate have been tried, including the use of black and white developing agents as accelerators for color development and the use of imidazolium salt derivatives. Numerous disadvantages have been experienced with additives for increasing developer activity. Among these disadvantages are an increase in stain, preferential acceleration of the individual dye layers (leading to color imbalances), insolubility or instability of the concentrates from which the developers are prepared, reactivity with other components of the developer, unacceptable color or odor in the developer, increased viscosity, toxicity, adverse environmental effects, prohibitive cost or availability, dye instability or deterioration, and hue changes of dye. Accordingly, there exists in the art a need for a method of increasing developer activity without the aforementioned disadvantages.

SUMMARY OF THE INVENTION

A color developer composition has now been found which maintains developer activity in all color forming layers, thus allowing the use of reduced temperature, time, replenishment rate, or concentration of total color developing agent without color imbalances or undesirable trade-offs in processing parameters. The present composition also permits increased developer capacity, reduces or eliminates tar formation, due at least in part to increased stability, and allows reduction in package size. The increased development activity is realized with all types of color photographic materials, whether involving color prints, color negatives, or positive color reversal images. The present composition does not affect dye stability, does not cause deleterious color shifts, is effective with the couplers currently employed in sensitized emulsions, and avoids many of the disadvantages of the additives previously reported in the literature.

The present composition achieves the aforementioned advantages by employing a combination of two or more color developing agents instead of the single color developing agent employed in conventional color developer compositions. The two or more color developing agents act in combination to produce results which are unexpected and not predicted from the use of each of the constituent color developing agents alone.

In one aspect, the present invention relates to a composition of two or more color developing agents. As the first color developing agent, a p-amino-N-dialkylaniline or salt thereof is employed, preferably 4-amino-3-methyl-N-ethyl-N-beta hydroxyethyl aniline, 4-amino-3-methyl-Ndiethyl aniline, 4-amino-3-methyl-N-ethyl-N-beta methanesulfonamidoethyl aniline, or a salt thereof. The other color developing agent or agents may be any p-amino-Ndialkylaniline or salt thereof different from the p-amino- N-dialkylaniline compound employed as the first color developing agent.

In another aspect, the invention relates to a method for maintaining the activity of a color developer composition.

In still another aspect, the invention relates to a method for increasing the capacity of a color developer composition.

In yet another aspect, the invention relates to a method for reducing tar formation in a color developer composition.

In a further aspect, the invention relates to a method for adjusting the color balance in a color developer composition.

In a still further aspect, the invention relates to increasing the processing latitude of color developer compositions, that is, variations in one or more parameters (such as processing time, temperature, replenishment rate, and developer concentration) may be larger than with known color developing compositions without adversely affecting overall processing performance. In other words, use of the present compositions can desensitize the overall processing performance to parametric variations.

The composition of the present invention may be employed in conventional color developing processes without any significant change in conventional processing procedures and steps.

DETAILED DESCRIPTION OF THE INVENTION

The color developer formulations using compositions of the present invention may be substantially the same as conventional color developer formulations containing an aromatic primary amine developing agent. The difference is that a composition of the present invention contains at least two color developing agents whereas a conventional formulation contains only one color developing agent. The color developing agents of the present invention are p-phenylenediamine derivatives such as those disclosed in U.S. Pat. Nos. 2,552,241, 2,566,271, and 3,658,525, and in an article entitled "Chemical Constitution, Electrochemical, Photographic And Allergenic Properties Of p-Amino-N-dialkylanilines" published in the Journal of the American Chemical Society, Volume 73, Pages 3100–3125 (1951).

The two or more color developing agents used in the present invention are different from one another and are each preferably selected from the group consisting of 4-amino-2-acetamido-N-diethyl aniline, 4-amino-2-methyl-N-diethyl aniline, 4-amino-2-methyl-N-dimethyl aniline, 4-amino-2,5-dimethyl-N-diethyl aniline, N-(4-aminophenyl)-morpholine, 2,4-diamino-N-diethyl aniline, N-(4-aminophenyl)-piperazine, N-(4-amino-3-methylphenyl)morpholine, 4-amino-N-ethyl-N-carbamylmethyl aniline, 4-amino-2-methoxy-N-diethyl aniline, 4-amino-3-chloro-N-diethyl aniline, 4-amino-3-methyl-N-ethyl-N-carbamylmethyl aniline, N-(4-aminophenyl)-piperidine, 4-amino-N-ethyl-N-beta-methoxyethyl aniline, 4-amino-N-ethyl-N-beta-acetamidoethyl aniline, 4-amino-N-ethyl-N-(N'-methyl-betamethylsulfonamidoethyl) aniline, 4-amino-N-ethyl-N-beta ethoxyethyl aniline, N-(4-amino-3-methylphenyl)-piperidine, 4-amino-2-methoxy-5-methyl-N-diethyl aniline, 4-amino-Ndimethylaniline, 4-amino-N-ethyl-N-tetrahydrofurfuryl aniline, 4-amino-N-methyl-Nethyl aniline, 4-amino-N-methyl-N-(n-butyl) aniline, 4-amino-N-methyl-N-(n-propyl) aniline, 4-amino-3-methyl-N-ethyl-N-(N'-methyl-beta-methylsulfonamidoethyl) aniline,-4-amino-N-diethyl aniline, 4-amino-3-(methylsulfonamido-methyl)-N-diethyl aniline, 4-amino-N-ethyl-N-beta methylsulfonamidoethyl aniline, 4-amino-3-hydroxymethyl-N-diethyl aniline, 4-amino-N-ethyl-N-(n-propyl) aniline, 4-amino-3-(beta-acetamidoethyl)-N-diethyl aniline, 4-amino-3-(beta-hydroxyethyl)-N-diethyl aniline, 4-amino-3-(beta-aminoethyl)-N-diethyl aniline, 4-aminr-N-ethyl-N-(betahydroxyethyl) aniline, 4-amino-N-di-(n-propyl) aniline, 4-amino-N-ethyl-N-beta aminoethyl aniline, 4-amino-3-methyl-N-methyl-N-beta methylsulfonamidoethyl aniline, 4-amino-3-ethyl-N-diethyl aniline, 4-amino-3-(N'-methyl-beta-methyl-sulfonamidoethyl)-N-diethyl aniline, 1-(4-aminophenyl)pyrrolidine, 4-amino-3-methyl-N-ethyl-N-tetrahydrofurfuryl aniline, 4-amino-3-(beta-methylsulfonamidoethyl)-N-diethyl aniline, 4-amino-3-acetamido-N-diethyl aniline, 4-amino-3-methyl-N-ethyl-N-beta methylsulfonamidoethyl aniline ("AEMT"), 4-amino-3-methyl-N-diethylaniline ("ADAT"), 6-amino-1-(beta-methylsulfonamidoethyl)-1,2-3,4-tetrahydroquinoline, 4-amino-3-methyl-N-ethyl-N-beta hydroxyethyl aniline ("AMEHEA"), 6-amino-1-ethyl-1,2,3,4-tetrahydroquinoline, 4-amino-3-ethoxy-N-ethyl-N-(N'-methyl-beta-methylsulfonamidoethyl) aniline, 5-amino-1-(beta-methyl-sulfonamidoethyl)-2,3-dihydroindole, 4-amino-3,5-dimethyl-N-diethyl aniline, 4-amino-3-ethoxy-N-ethyl-N-beta methylsulfonamidoethyl aniline, 4-amino-3-methoxy-N-diethyl aniline, 4-amino-3-ethoxy-N-diethyl aniline and the salts thereof.

Any salt of these compounds which is effective as a color developing agent may be employed. For example, the sulfate, hydrochloride, sulfite, p-toluene-sulfonate and phosphate salts of these compounds, may be employed.

Preferably, the color developing agents used in the present compositions are different from one another and are selected from the group consisting of 4-amino-3-methyl-N-ethyl-N-beta hydroxyethyl aniline, 4-amino-3-methyl-N-ethyl-N-beta methanesulfonamidoethyl aniline, 4-amino-3-methyl-N-diethyl aniline, 4-amino-N-diethyl aniline, 4-amino-3-(beta-methylsulfonamidoethyl)-N-diethyl aniline, and the salts thereof. It is particularly preferred to employ 4-amino-3-methyl-N-ethyl-N-beta methanesulfonamidoethyl aniline or a salt thereof in combination with 4-amino-3-methyl-N-ethyl-N-beta hydroxyethyl aniline or a salt thereof.

For the development of color prints, it is preferred to employ 4-amino-3-methyl-N-ethyl-N-beta methanesulfonamidoethyl aniline or a salt thereof in combination with 4-amino-3-methyl-N-diethyl aniline, 4-amino-3-methyl-N-ethyl-N-beta hydroxyethyl aniline, 4-amino-N-diethyl aniline, or a salt thereof. Another preferred combination of developers for color prints is 4-amino-3-methyl-N-ethyl-N-beta methanesulfonamidoethyl aniline or a salt thereof, 4-amino-3-methyl-N-diethyl aniline or a salt thereof, and 4-amino-3-methyl-N-ethyl-N-beta hydroxyethyl aniline or a salt thereof.

For use in developing color negative film, it is preferred to employ 4-amino-3-methyl-N-ethyl-N-beta hydroxyethyl aniline or a salt thereof in combination with 4-amino-3-methyl-N-diethyl aniline or a salt thereof.

A color developer composition of the present invention may be formulated as one or more liquid or solid concentrates, and then combined and diluted with water to form a working color developer bath for processing color prints, film, or the like, or the composition may be formulated directly as working color developer bath. The color developing agent composition of this invention preferably is present in a total amount sufficient to provide a concentration in the working color developer bath of from about 0.1 to about 20 g/liter, more preferably from about 0.5 to about 10 g/liter. Typically, the color developing agents used in the present compositions are employed in a molar ratio of up to 50:1. The relative amounts of the agents will vary depending on the particular application. The pH of the working color developer bath typically is within the range of from about 7 to about 14, preferably from about 10 to about 13.

Conventional color developer ingredients may be incorporated into color developer formulations containing the developer compositions of this invention. For example, an alkali agent and a buffer agent, such as sodium hydroxide, potassium hydroxide, sodium carbonate, potassium carbonate, sodium or potassium tertiary phosphate, potassium metaborate, borax, or the like can be added individually or in combination. A suitable amount of the alkali agent and the buffer agent may range from about 1 to about 50 g/liter of the working color developer bath.

Further, various salts such as disodium or dipotassium hydrogen phosphate, potassium or sodium dihydrogenphosphate, sodium or potassium bicarbonate, boric acid, an alkali metal nitrate, an alkali metal sulfate, and the like can be used in the formulations to impart a buffer capability, for the convenience of preparation, or for increasing the ionic strength.

Optional development accelerators may be added. They include various pyridinium compounds and other cationic compounds, cationic dyes such as phenosafranine, neutral salts such as thallium nitrate or potassium nitrate, polyethylene glycol or derivatives thereof, nonionic compounds such as polythioethers, organic solvents, and organic amines (ethanolamine, ethylene diamine, and diethanol amine). Benzyl alcohol and phenylethyl alcohol, pyridine, ammonia, and hydrazine are also useful development accelerators. A suitable amount of the development accelerator can range from about 0.01 to about 50 g/liter of the working color developer bath.

Sodium sulfite, potassium sulfite, potassium bisulfite, or sodium bisulfite, all of which are conventionally used as antioxidants, may also be added. A suitable amount of these conventional antioxidants can range from about 0.1 to about 10 g/liter of the working color developer bath. Antifogging agents may be added, if desired, generally in an amount of from about 0.001 to about 5 g/liter of the working color developer bath. Alkali metal halides and organic antifogging agents may be used.

Polyphosphoric acid compounds (e.g., sodium hexametaphosphate, sodium tetrapolyphosphate, sodium tripolyphosphate, or the potassium salts hydroxyalkanediphosphoric acids, aminopolycarboxylic acids (e.g., ethylenediaminetetraacetic acid, nitrilotriacetic acid, cyclohexanediaminetetraacetic acid, iminodiacetic acid, N-hydroxymethylethylenediaminetriacetic acid, diethylene-triaminepentaacetic acid), or combinations thereof may be added as a water softener. These compounds are typically added in an amount of from about 0.5 to about 1 g/liter of the working color developer bath, although the amount varies depending upon the hardness of the water used to prepare the working solution. Other sequestering agents may also be used.

In the case of reversal color processing, a competing coupler and a fogging agent may also be added to the color developer formulations. An example of a useful competing coupler is citrazinic acid. Alkali metal borohydrides, amineboranes, ethylenediamine, or the like may be used as the fogging agent. A suitable amount of fogging agent can range from about 0.01 to about 20 g/liter of the working color developer bath.

Compositions of the present invention may be used to process any conventional silver halide color photographic material, including color negative films, color papers, color positive films, and color reversal films. The color developer composition of the present invention may be useful in color photographic processing wherein couplers are incorporated into the developer solution or the developing agents are incorporated into the photographic emulsion.

The fundamental processing steps for imagewise exposed color negative films, color positive films, color print papers, or the like are usually as follows:

(1) Color development—Bleaching—Washing—Fixing—Washing—Stabilizing—Drying; or (2) Color development—Bleach-fixing—Washing—Stabilizing—Drying; or (3) Color development—Stop-fixing—Bleach-fixing—Washing—Stabilizing—Drying.

In (1) to (3), a pre-bath or a hardening bath may also be employed before color development, and a stabilizing bath or a washing after bleaching may be omitted.

The processing steps for imagewise exposed color reversal films usually involve the following fundamental steps:

(4) Black-and-white development—Stopping—Washing—Fogging—Washing—Color development—Bleaching—Washing—Fixing —Washing—Stabilizing—Drying.

In (4) a pre-bath, a prehardening bath, a neutralizing bath, or the like may be provided, and a stabilizing bath, a washing after bleaching, and the like may be omitted. A fogging bath may be replaced by a reexposure to light or may be omitted by adding a fogging agent to the color developing bath, for example, t-butylamineborane, sodium borohydride, tin-aminopolycarboxylic acid complex salt, or the like.

The color developer composition of the present invention is useful in the above-described processes (1) through (4) but is not limited to use in these processes.

Processes employing the color developer compositions of this invention can vary widely in regard to such features as development time and development temperature. Thus, for example, the development time will typically be in the range of from about 0.5 to about 30 minutes, and more usually in the range of from about 1 to about 10 minutes. The development temperature will typically be in the range of from about 20° C. to about 70° C., and more usually in the range of from about 30° C. to about 50° C.

The development temperature and/or development time employing the color developer compositions of the present invention may be less than for conventional compositions and less frequent replenishment will typically be required. For example, in color print processing the developing time may be reduced from a typical time of 3.5 minutes to about 1.5 minutes, temperatures may be reduced from about 33° C. and to about 18° C., and the replenishment rate may be reduced from about 323 ml/m$^2$ to about 100 ml/m$^2$. By varying the developing parameters, more extensive reductions may be obtained. For example, employing temperatures in excess of 33° C. may permit the use of processing times of less than 1.5 minutes.

Thus, developer activity may be maintained at conventional levels even though the development time, temperature, or replenishment rate is reduced below conventional levels. Alternatively, an increase in developer activity may be obtained if the development time, temperature, and/or replenishment rate are maintained at conventional levels, or both developer activity and developing parameters may be maintained at conventional levels to reduce the volume of developer concentrate containing the developing agent compositions of this invention. It is contemplated that the color developer compositions of the present invention may be formulated as two or more solid or liquid component parts, although the component parts typically will be formulated as aqueous solutions.

The following example presents illustrative but nonlimiting embodiments of the present invention. Comparative tests are also presented.

A series of tests was performed using photographic developer solutions that differed principally in the color developer agent(s) employed. The overall composition of each solution is shown in Table I and the particular color developer agent(s) used in each solution is (are) shown in Table II.

TABLE I

| Ingredient | Concentration, g/l (±5%) |
|---|---|
| Deionized Water | 800.0 |
| Hydroxylamine Sulfate | 3.0 |
| Ethylene Glycol | 6.0 |
| Optical Brightener | 1.0 |
| Benzyl Alcohol | 16.0 |
| AEMT Phosphate Mono Methanolate | * |
| AMEHEA Sulfate | * |
| ADAT Hydrochloride | * |
| Potassium Hydroxide, 45% | 4.5 |
| Sodium Bromide | 0.6–0.9** |
| Chelates | 2.0 |
| Sodium Bisulfite | 1.5 |
| Potassium Carbonate | 31.0 |
| Add Deionized Water to | 1000 mls |
| pH at 25° C. | about 10.15 |

*As specified in Table II.

**0.6 used at 92° F., 100° F. and 104° F.; 0.9 used at 95° F.

TABLE II

| Test No. | Solution | AEMT—$PO_4$ -MeOH g/L | AMEHEA-$SO_4$ g/L | ADAT—HCl g/L |
|---|---|---|---|---|
| 1 | 1[a] | 5.0 | — | — |
| | 2 | 3.8 | 0.3 | — |
| | 3 | 3.0 | 0.3 | 0.05 |
| 2 | 4[a] | 4.8 | — | — |
| | 5[a] | 4.5 | — | — |
| | 6[a] | 4.3 | — | — |
| | 7[a] | 4.0 | — | — |
| | 8[a] | 3.8 | — | — |
| | 9 | 3.6 | 0.5 | — |
| | 10 | 3.4 | 0.5 | — |
| | 11 | 3.2 | 0.5 | — |
| | 12 | 3.0 | 0.5 | — |
| 3,4 | 13[a] | 5.0 | — | — |
| | 14 | 5.0 | 1.5 | — |
| 5 | 15[a] | 4.0 | — | — |
| | 16 | 4.0 | 0.8 | — |
| 6 | 17[a] | 5.0 | — | — |
| | 18 | 5.0 | 0.15 | — |

[a]Comparative solution using single developer agent.

In each test, a photographic color print paper comprising a polyethylene-coated paper base bearing in order a red-light-sensitive gelatin silver halide emulsion layer containing a cyan-dye-forming coupler, a green-light-sensitive gelatin silver halide emulsion layer containing a magenta-dye-forming coupler, and a blue-light-sensitive gelatin silver halide emulsion layer containing a yellow-dye-forming coupler was exposed, developed in the working color developing solution, bleach-fixed, washed, dried and tested to determine the densities of the red, green, and blue dye images. The resulting red, green, and blue integral densities were read on a reflection densitometer, MacBeth Model RD-519. The time, temperature, and results are listed separately for each test.

Test 1

Working color developer solutions 1, 2, and 3 were prepared. In this test, development temperature was 33.3° C. and the development time was 3.5 minutes. The results are summarized below:

| Color Developer Solution | High Density | | | Low Density | | |
|---|---|---|---|---|---|---|
| | Red | Green | Blue | Red | Green | Blue |
| 1[a] | BV[b] | BV[b] | BV[b] | BV[b] | BV[b] | BV[b] |
| 2 | +0.02 | +0.05 | 0.00 | −0.01 | +0.01 | −0.02 |
| 3 | −0.04 | 0.00 | −0.04 | −0.02 | +0.01 | −0.02 |

[a]Comparative
[b]Base value.

The data indicate that solutions 2 and 3, which are illustrative of the present invention, maintained an activity equivalent to solution 1 at a reduced total concentration of color developing agents. This allows both reduced volume of liquid concentrates and reduced concentration of organic chemicals in the spent solution.

Test 2

Solutions 4 through 12 were prepared and processed at 95° F. using a 3.5 minute development time. The results are summarized below:

| Color Developer Solution | High Density | | | Low Density | | |
|---|---|---|---|---|---|---|
| | Red | Green | Blue | Red | Green | Blue |
| 4[a] | BV[b] | BV[b] | BV[b] | BV[b] | BV[b] | BV[b] |
| 5[a] | −0.05 | −0.06 | −0.05 | −0.02 | −0.02 | −0.03 |
| 6[a] | −0.08 | −0.09 | −0.08 | −0.04 | −0.03 | −0.06 |
| 7[a] | −0.11 | −0.10 | −0.11 | −0.05 | −0.05 | −0.08 |
| 8[a] | −0.18 | −0.18 | −0.18 | −0.07 | −0.07 | −0.10 |
| 9 | −0.02 | 0.00 | −0.01 | 0.00 | +0.01 | +0.02 |
| 10 | −0.05 | −0.02 | −0.03 | −0.01 | 0.00 | +0.01 |
| 11 | −0.04 | −0.02 | −0.02 | 0.00 | +0.01 | +0.02 |
| 12 | −0.06 | −0.03 | −0.03 | −0.02 | −0.01 | 0.00 |

[a]Comparative.
[b]Base value.

The data indicate that the addition of AMEHEA to the developer solution reduces the loss in activity as total developing agent concentration is reduced. This allows a reduction in total developing agent concentration without a significant loss in photographic activity. This would not be possible if only a single color developing agent were utilized.

Test 3

Colorprint paper with an average exposure of 33% was processed through one liter of each of solutions 13 and 14 until the baths had reached their capacity. Development time was 1.75 minutes and temperature was 40° C. Capacity was determined as the amount of paper that could be processed through the developer without replenishment and still produce acceptable density levels. Blue density, the most sensitive to bath exhaustion, was monitored. The data are as follows:

| Color Developer Solution | Square Feet of Paper Processed | Blue Density | Reduction In Blue Density |
|---|---|---|---|
| 13[a] | 0.0 | 1.40 | — |
| | 6.4 | 1.18 | 0.22 |
| | 12.8 | 0.95 | 0.45 |
| | 19.2 | 0.73 | 0.67 |
| | 25.6 | 0.50 | 0.90 |
| 14 | 0.0 | 1.42 | — |

-continued

| Color Developer Solution | Square Feet of Paper Processed | Blue Density | Reduction In Blue Density |
|---|---|---|---|
| | 6.4 | 1.13 | 0.29 |
| | 12.8 | 1.08 | 0.36 |
| | 19.2 | 1.00 | 0.42 |
| | 25.6 | 0.92 | 0.50 |

[a]Comparative.

Developer capacity was considered to be reached after a loss of 0.45 to 0.50 density units occurred. Beyond this, density loss could not be compensated for by exposure. Solution 14 had nearly twice the developer capacity of solution 13, because nearly twice as much paper was processed before unacceptable densities were reached. This illustrates that the present invention makes it possible to increase developer capacity.

Test 4

Colorprint paper, which had been stepwise exposed, was processed using solutions 13 and 14. Solution 13 was tested at two conditions: standard (3.5 minutes development time and 92° F.) and experimental reduced time and higher temperature (1.75 minutes development time and 104° F.). Solution 14 was tested at 1.75 minutes development time and 100° F.

Densitometric readings of prints showed red and green densities for solution 13 at the experimental conditions and solution 14 to be comparable to the standard developer.

However, only solution 14 showed acceptable blue density to the standard developer. This shows that the present invention makes shorter developing times possible.

Test 5

Solutions 15 and 16 were stored at room temperature in glass beakers with watchglass covers to minimize evaporation and keep out dirt. Examination after 96 hours showed solution 15 to be darker in color and that tar had settled on the bottom of the beaker. Solution 16, however, was unchanged in color and very little ar had settled.

Test 6

Solutions 17 and 18 were prepared and processed at 92° F. using a 3.5 minute development time. The results are summarized below:

| Color Developer Solution | High Density | | | Low Density | | |
|---|---|---|---|---|---|---|
| | Red | Green | Blue | Red | Green | Blue |
| 17[a] | BV[b] | BV[b] | BV[b] | BV[b] | BV[b] | BV[b] |
| 18 | +0.10 | +0.10 | +0.10 | +0.04 | +0.03 | +0.04 |

[a]Comparative.
[b]Base value.

The data indicate that solution 18, which is an illustrative embodiment of the present invention, produced an increase in overall developer activity in all three color layers as compared to solution 17. Solution 18 can be used commercially with reduced processing times or at reduced replenishment rates or at reduced temperatures and still maintain an activity equivalent to solution 17.

We claim:

1. A color developer composition for use in developing color print paper, wherein the color developer composition comprises 4-amino-3-methyl-N-ethyl-N-beta-methanesulfonamidoethyl aniline or a salt thereof, 4-amino-3-methyl-N-ehtyl-N-beta hydroxyethyl aminline or a salt thereof, and 4-amino-3-methyl-N-diethyl aniline or a salt thereof.

* * * * *